US005564906A

United States Patent [19]

Bennitt et al.

[11] Patent Number: 5,564,906

[45] Date of Patent: Oct. 15, 1996

[54] MEANS FOR MOVING A VALVE WITHIN A GAS COMPRESSOR HAVING A STRAIGHT CYLINDER

[75] Inventors: Robert A. Bennitt, Painted Post; Derek Woollatt, Campbell, both of N.Y.

[73] Assignee: Dresser-Rand Company, Corning, N.Y.

[21] Appl. No.: 561,769

[22] Filed: Nov. 22, 1995

[51] Int. Cl.[6] ..... F01B 31/14; F04B 39/10

[52] U.S. Cl. ..... 417/238; 92/13.6

[58] Field of Search ..... 417/238, 525, 417/534, 569; 92/13.6, 13.8; 137/565

[56] References Cited

U.S. PATENT DOCUMENTS 3,884,125 5/1975 Massie ..... 92/13.6

4,012,173 3/1977 Everson ..... 92/13.6

5,141,413 8/1992 Bennitt ..... 417/534

*Primary Examiner*—Timothy S. Thorpe

*Assistant Examiner*—Roland G. McAndrews, Jr.

*Attorney, Agent, or Firm*—Bernard J. Murphy

[57] ABSTRACT

An elongated sleeve, externally threaded, is threadedly engaged with threaded bores in transverse walls formed in a straight cylinder of a gas compressor. A nut is secured to an intermediate portion of the sleeve, by means of a setscrew, and an end of the sleeve threadedly mounts a valve. The cylinder wall has an aperture formed therein to provide access for an open-end wrench, so that the wrench can work the nut to cause rotation of the nut and the sleeve, and move the valve outwardly or inwardly of the cylinder, as the valve is wholly confined within the cylinder at the frame-end thereof, and is otherwise inaccessible for movement.

9 Claims, 1 Drawing Sheet

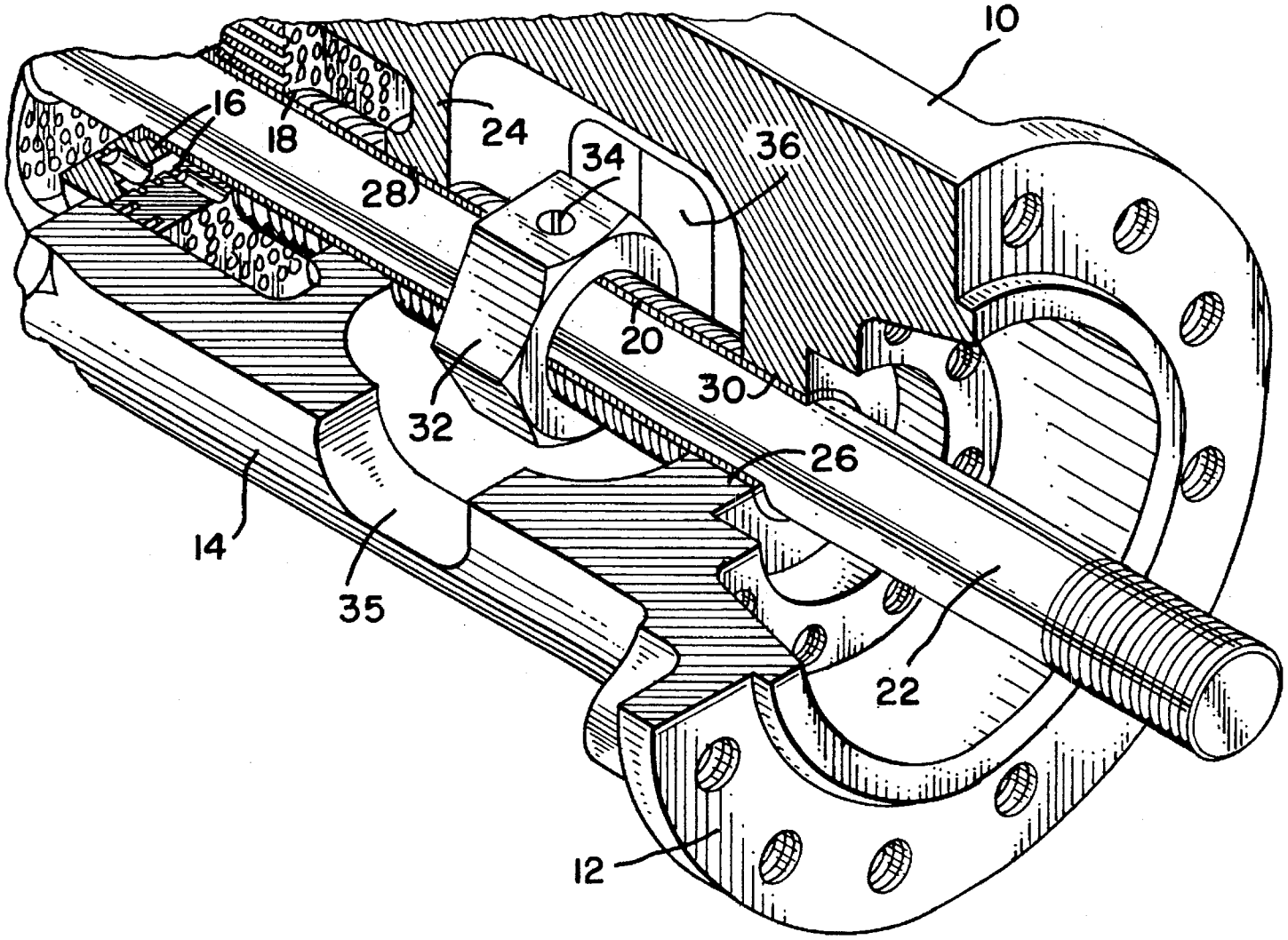
10
36
34
24
28
18
16
20
30
26
22
32
35
14
12

MEANS FOR MOVING A VALVE WITHIN A GAS COMPRESSOR HAVING A STRAIGHT CYLINDER

This invention pertains to gas compressors, especially those of the reciprocating type, and in particular to a gas compressor of the aforesaid type which has a one-way, fluid-control valve wholly confined with the circumferential wall of the compressor cylinder, and means for moving the valve lengthwise of the cylinder, for varying a clearance pocket within the cylinder.

The clearance volume or clearance pocket of gas compressors is normally varied to alter the capacity of the compressor by extraneous devices and/or components attached to the cylinder head. Such devices or components are designed to satisfy that very function: varying the volume or pocket obtaining between the piston and the cylinder head.

In U.S. Pat. No. 5,141,413, issued on Aug. 25, 1992, to Robert A. Bennitt, for a Gas Compressor Having A Variable-Volume Clearance Pocket, And Means for Varying A Clearance Pocket In A Gas Compressor, there is disclosed means for moving a valve, relative to a second valve which functions as a piston, in a straight cylinder compressor. All the valves, intake and discharge, are wholly confined within the cylinder, and the cylinder has an outer end, and a frame end to which a prime mover (not shown) is coupled. The U.S. Pat. No. 5,141,413 teaches how to move an outer end valve, by means of a valve-mounting centerbolt which extends outwardly from the cylinder and has wrenching flats for receiving the adjusting tool.

As U.S. Pat. No. 5,141,413 shows, and said patent is incorporated herein by reference for a fuller understanding of, and by way of background, for the instant invention, there is no adjusting means for, or access to the frame end valve. The one-way, fluid-control valve, set in the frame end of the compressor, is wholly enclosed by the circumferential wall of the compressor cylinder. Clearly, there is no evident way of adjusting the disposition of the latter valve, after the compressor is assembled. However, it would be most desirable to be able to adjust this valve, lengthwise of the compressor cylinder, in order to vary the frame-end clearance pocket as well.

It is an object of this invention to set forth a facile means for adjusting such a frame-end valve, confined within a compressor cylinder, lengthwise of the latter, to the end of varying the frame-end clearance pocket.

Particularly, it is an object of this invention to disclose, in a gas compressor having (a) a straight cylinder with a circumferential wall, and (b) a one-way, fluid-control valve wholly confined within said wall, means within said cylinder for moving said valve lengthwise of said cylinder, comprising an elongated sleeve, supported within said cylinder; and a nut fixed to an intermediate portion of said sleeve; wherein said valve is coupled to an end of said sleeve for movement therewith; and an aperture, formed through said wall, (a) exposing said nut, and (b) providing access to said nut for a nut-engaging and -rotating tool.

Further objects of this invention, as well as the novel features thereof, will become apparent by reference to the following description, taken in conjunction with the accompanying figure, the figure being a perspective illustration, partly cut-away and cross-sectioned, of the frame-end of a straight cylinder having one-way fluid valves confined therein.

As shown in the figure, a gas compressor having a straight cylinder 10 comprises a mounting flange 12 for coupling thereto a prime mover (not shown). The cylinder 10 has a circumferential wall 14. A one-way, fluid-control valve 16 is wholly confined within the wall 14. The valve 16 is centrally bored and tapped at 18, and is threadedly fastened to an end of an externally-threaded sleeve 20. The sleeve 20 slidably accommodates therewithin a reciprocable rod 22. The rod 22, as explained in the priorly cited U.S. Pat. No. 5,141,413, is used to cause reciprocating translation of a pair of spaced-apart, one-way, fluid control valves. One of the rod-carried valves cooperates with valve 16 to compress gas within the cylinder, and the closing distance between these valves defines the clearance pocket at this frame-end of the cylinder 10.

The cylinder 10 has a pair of spaced-apart, transverse walls 24 and 26, and each thereof have threaded bores 28 and 30, respectively, formed therein. The sleeve 20 is threadedly engaged with said bores 28 and 30, and supported in the cylinder 10 by the walls 24 and 26. Intermediate the length of the sleeve 20 is a hexagonal nut 32. A setscrew 34, in penetration of the nut 32, is in fast engagement with the sleeve 20. Accordingly, upon rotation of the nut 32, the sleeve 20 retracts toward the flange end of the cylinder 10, or advances inwardly of the cylinder, and carries the valve 16 therewith. As a means of accessing nut 32, to effect its rotation, the cylinder 10 has a pair of apertures 35 and 36 formed therein on opposite sides of the cylinder 10. One has only to insert an open-end wrench, through one of the apertures 35 and 36, to work the nut 32 (a) to move the valve 16 lengthwise of the cylinder, and (b) accordingly, vary the clearance volume of the compressor at this frame-end thereof. Rotation of the nut 32 causes the sleeve 20 to threadedly move through the bores 28 and 30, and move the valve 16 away from, or more into proximity with its confronting valve.

While we have described our invention, in connection with a specific embodiment thereof, it is to be clearly understood that this is done only by way of example, and not as a limitation to the scope of the invention, as set forth in the objects thereof, and in the appended claims. The nut 32 is shown as of hexagonal configuration, to accommodate its working by an open-end wrench. Clearly, nut 32 could be supplanted by a spanner nut for working by a spanner wrench. Too, the nut 32 could be supplanted with a helical-tooth gear, and an inter-engaging worm could be supported, across the gear, in the cylinder walls, with a handwheel at the end of the worm, external of the cylinder, for selective rotation of the worm. These, and all other variations of the invention, as will occur to other by taking teaching from our disclosure, are deemed to be within the ambit of our invention, and embraced by the appended claims.

We claim:

1. In a gas compressor having (a) a straight cylinder with a circumferential wall, and (b) a one-way, fluid-control valve wholly confined within said wall, means within said cylinder for moving said valve lengthwise of said cylinder, comprising:

an elongated sleeve, supported within said cylinder; and a nut fixed to an intermediate portion of said sleeve; wherein said valve is coupled to an end of said sleeve for movement therewith; and an aperture, formed through said wall, (a) exposing said nut, and (b) providing access to said nut for a nut-engaging and -rotating tool.

2. Valve moving means, according to claim 1, wherein:

said nut is fixed to said sleeve, as aforesaid, by means of a setscrew in penetration of said nut and engaging said sleeve.

3. Valve moving means, according to claim 1, wherein:

said cylinder has a frame- and powered-end; and said valve is enclosed within said end.

4. Valve moving means, according to claim 1, wherein:

said cylinder has a pair of spaced-apart, transverse walls formed therewithin;

said walls have threaded boreholes formed therein; and said sleeve is threadedly engaged with said boreholes.

5. Valve moving means, according to claim 1, wherein:

said aperture is formed in said wall, at one side thereof; and a second aperture is formed in said wall, at an opposite side thereof.

6. In a gas compressor having (a) a straight cylinder with a circumferential wall, and (b) a one-way, fluid-control valve wholly confined within said wall, means within said cylinder for moving said valve lengthwise of said cylinder, comprising:

an elongated sleeve, supported within said cylinder; and an annular element fixed to an intermediate portion of said sleeve; wherein said valve is coupled to an end of said sleeve for movement therewith; and means formed in said wall for providing through-wall access for a device for (a) engaging said element with said device, and (b) causing rotation of said element and concomitant translation of said sleeve.

7. Valve moving means, according to claim 6, wherein:

said annular element comprises a nut; and said nut is fixed to said sleeve by means of a setscrew in penetration of said nut and in fast engagement with said sleeve.

8. Valve moving means, according to claim 6, wherein:

said cylinder has a pair of spaced-apart, tranverse walls formed therewithin;

said walls have threaded boreholes formed therein; and said sleeve is externally threaded, and threadedly engaged with said bores.

9. Valve moving means, according to claim 6, wherein:

said through-wall access providing means comprises at least one aperture formed through said wall in generally radial alignment with said element.

* * * * *